United States Patent [19]

Britton et al.

[11] 4,412,759

[45] Nov. 1, 1983

[54] REACH ROD GROUTING SYSTEM

[75] Inventors: Frederick G. Britton, Bedford; Don B. Landers, Arlington, both of Tex.

[73] Assignee: Oil States Industries, Inc., Arlington, Tex.

[21] Appl. No.: 161,734

[22] Filed: Jun. 23, 1980

Related U.S. Application Data

[63] Continuation-in-part of Ser. No. 904,747, May 11, 1978, abandoned.

[51] Int. Cl.[3] ..... E02B 17/02; E02D 21/00

[52] U.S. Cl. ..... 405/225; 405/205; 405/227

[58] Field of Search ..... 405/195, 203, 205, 222–227; 137/236.5; 251/352

[56] References Cited

U.S. PATENT DOCUMENTS

| | | | |
|---|---|---|---|
| 3,878,687 | 4/1975 | Tragesser | 405/227 X |
| 4,140,426 | 2/1979 | Knox | 405/225 |
| 4,240,767 | 12/1980 | Gracia | 405/227 |

FOREIGN PATENT DOCUMENTS

| | | | |
|---|---|---|---|
| 933762 | 9/1973 | Canada | 405/225 |

*Primary Examiner*—David H. Corbin

*Attorney, Agent, or Firm*—Arnold, White & Durkee

[57] ABSTRACT

An offshore marine combination reach rod and grouting system wherein a reach rod extended from the upper end of an offshore platform leg or piling and piling sleeve to a flood valve connected to the lower end of a leg annulus passes through one or more tee connections as part of a grout feeding system to the leg annulus. The reach rod in the form of a hollow pipe is connected through flexible lines to flush water and grout feeding sources that permit twisting of the reach rod pipe to open and close the flood valve.

36 Claims, 15 Drawing Figures

REACH ROD GROUTING SYSTEM

Figure 1:
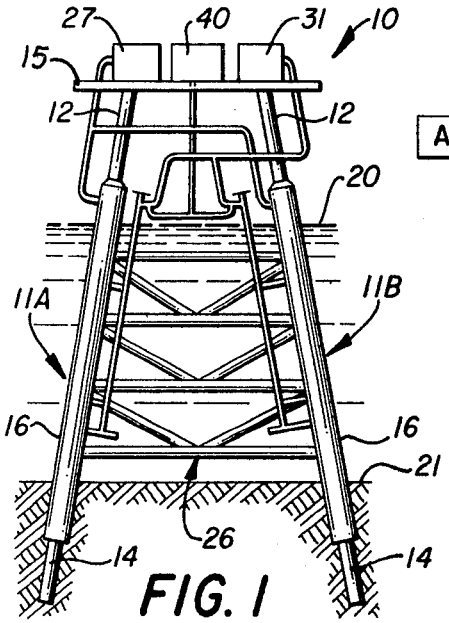

This application is a continuation-in-part of previous application by the same inventors, Ser. No. 904,747, filed May 11, 1978, entitled REACH ROD GROUTING SYSTEM, now abandoned.

This invention relates in general to offshore marine platform structures and to grouting of platform leg annuluses, and more particularly, to a combination leg annulus flood valve reach rod and grout feed system.

In erecting an offshore marine platform structure, the practice generally is to fabricate the platform structure on land, seal the hollow leg and brace members, and then tow it to the desired site, for installation-using the sealed leg members as flotation pontoons. Then, the leg members are flooded at controlled rates to erect the platform structure. A typical method for securing the structure to the floor of the offshore site is by driving piles into the floor, through piling guide sleeves mounted on the legs. The pile is then made unitary with the sleeve through which it passes by filling the annulus between the pile and the sleeve with a grouting material such as concrete. After the pile is driven into place, and prior to filling the annulus with grout, a sleeve packer may typically be inflated to seal the annulus. Such an inflatable packer is described in U.S. Pat. No. 3,468,132, for example, assigned to the assignee of this invention. In any event many of the offshore structures that are pre-assembled employ reach rods for each sealed leg for control of the flood valve of respective piling and piling sleeve legs in up-ending and setting of the structure at the selected site. Applicants employ the reach rod in the form of a pipe not only for controlling the opening and closing of the flood valve for each leg but also as grout feed line piping without the additional expense and complexity of running a separate grout line. This system gives the benefit of a grouting system and procedure wherein grout being fed to a leg annulus displaces water toward the leg annulus top and out the top with the grout being pumped into the annulus at the bottom of the leg. It has been established that when grouting the jacket annulus of legs, the texture and strength of the grout remains more predictably uniform and constant when water within a leg annulus is displaced by the grout pumped in from the bottom of a leg annulus than when grout is poured in from the top to filter down through trapped water in the annulus between a leg jacket sleeve and the driven pile. There are occasions when a grout feed fixture becomes clogged and/or it may be advantageous to feed grout by stages particularly with bigger greater water depth offshore platforms and as a result applicants present, in addition to a one tee reach rod grout feed system, a multi-tee (usually two tee) reach rod grout feed system.

It is therefore a principal object of this invention to provide improved grouting to the annulus between a piling and a piling sleeve sealed at the top and having an annulus seal at the bottom.

Another object is to minimize water and/or mud dilution and contamination of grout applied by application of the grout low in the annulus of an offshore platform leg or piling and piling sleeve.

A further object of the grouting structure is to minimize structure required through use of existing flood valve reach rods as grout feed lines.

Still another object is to provide a multi-stage grouting feed structure in a combined flood valve reach rod and grout system.

Features of the invention useful in accomplishing the above objects include, in a flood valve reach rod grouting system for offshore platform legs, grout feed to the annulus between a piling and a piling sleeve that is sealed at the top and that has a sealing structure set in place at the bottom of the annulus. A combination flood valve reach rod and grout system line element as a structure extends from the upper end of an offshore platform leg or piling and piling sleeve to a flood valve connected to the lower end of the leg annulus passes through one or more tee connections as part of a grout feeding system to the leg annulus. The reach rod is in the form, generally, of a hollow pipe connected through flexible lines, or a slip joint fitting, to flush water and grout feeding sources that permit twisting of the reach rod pipe to open and close the flood valve. Further, in another embodiment the flood valve is a three way valve that has open and close positions to flood water or the purging of water from an annulus by air pressure in reverse and a third position to feed grout through the flood valve and flood valve line to the annulus with grout being pumped down the reach rod piping.

Specific embodiments representing what are presently regarded as the best modes of carrying out the invention are illustrated in the accompanying drawings.

Figure 2:
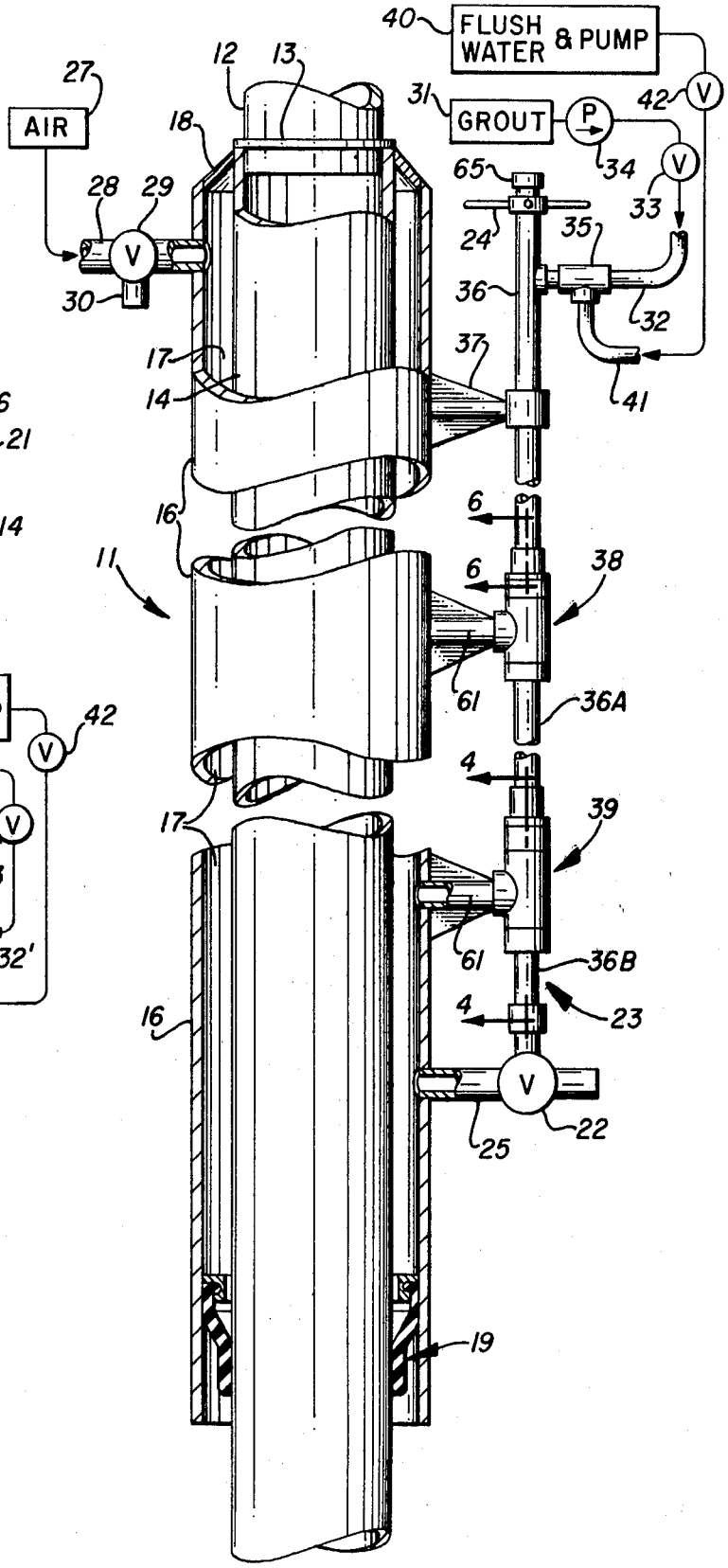
Figure 3:
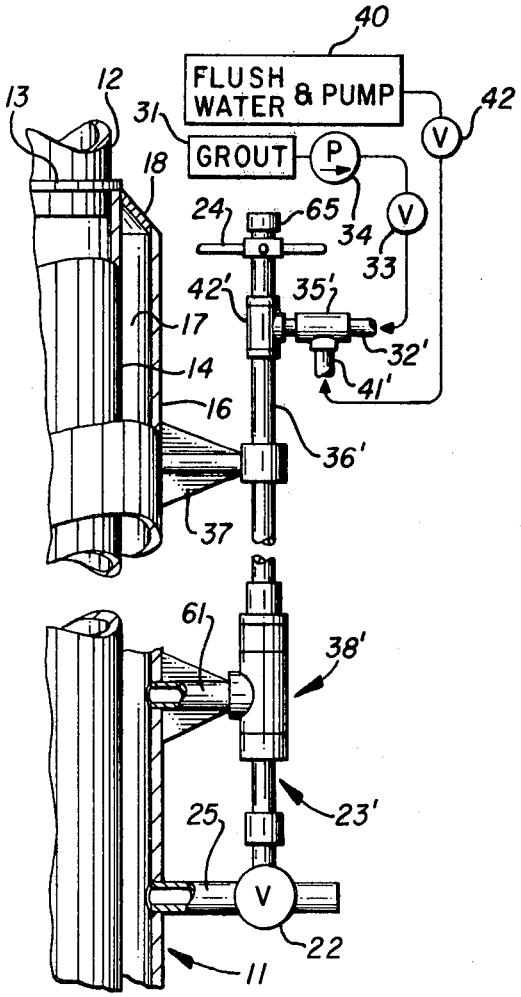
Figure 4:
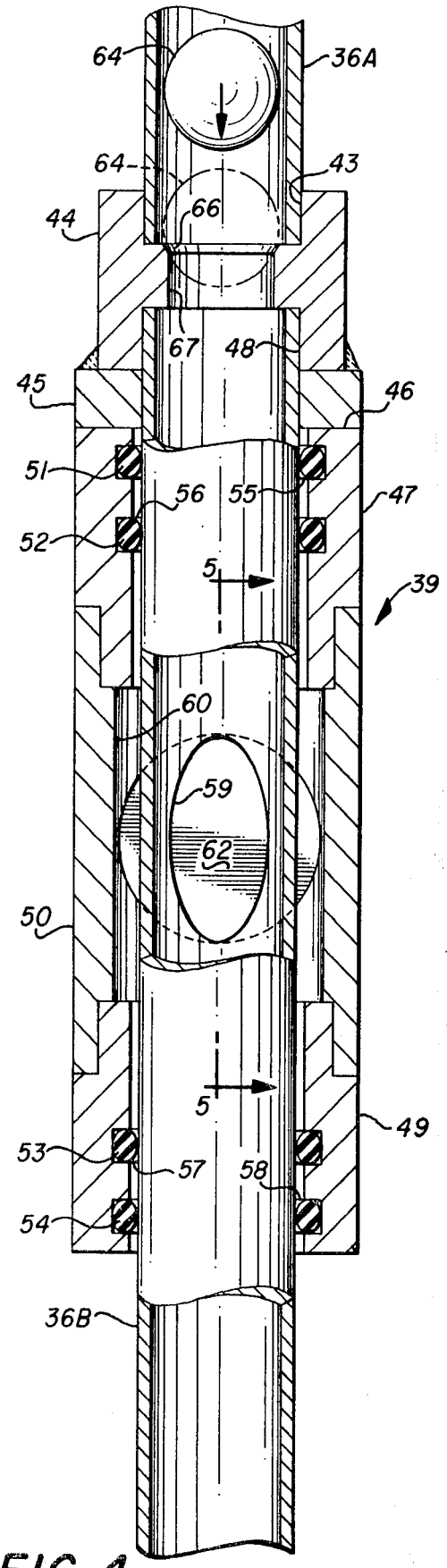
Figure 5:
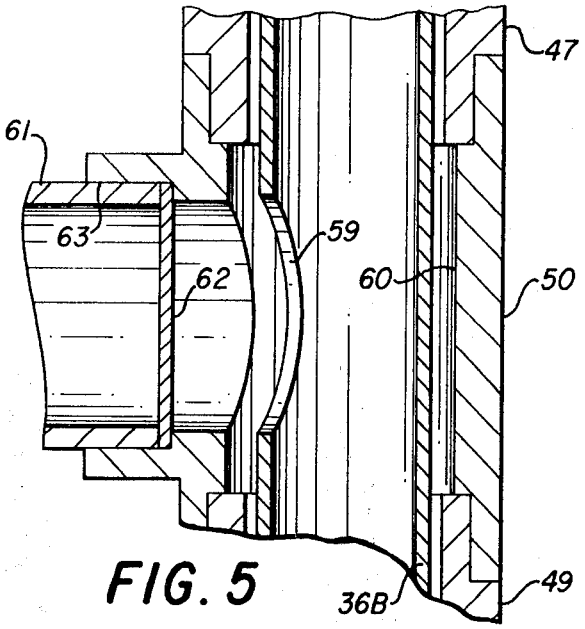
Figure 6:
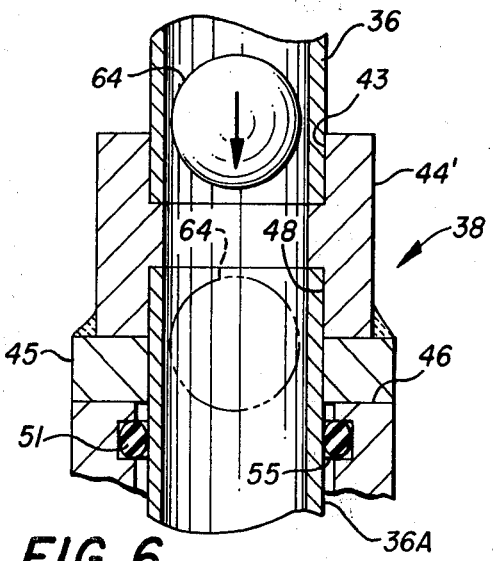
Figure 7:
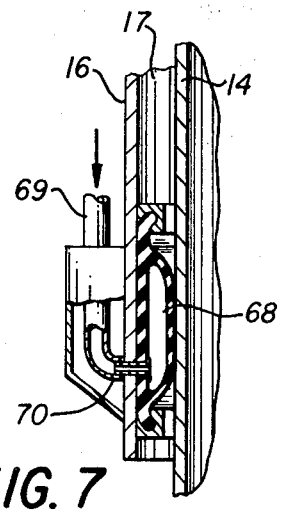
Figure 8:
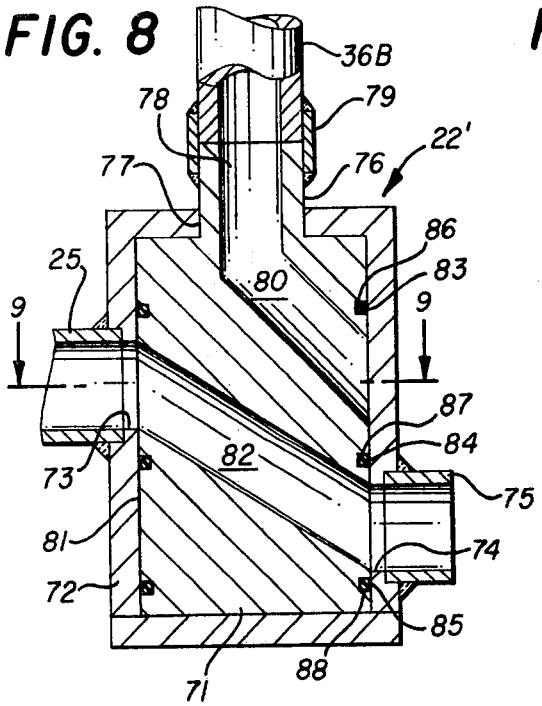
Figure 9:
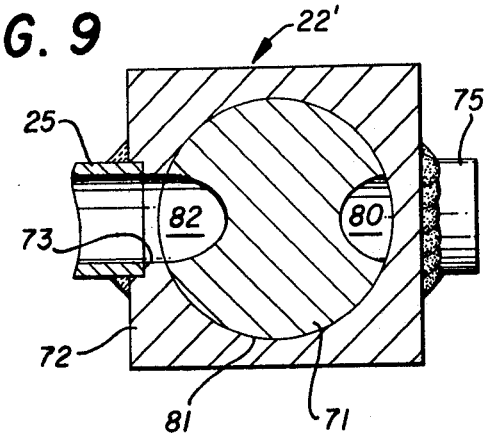
Figure 11:
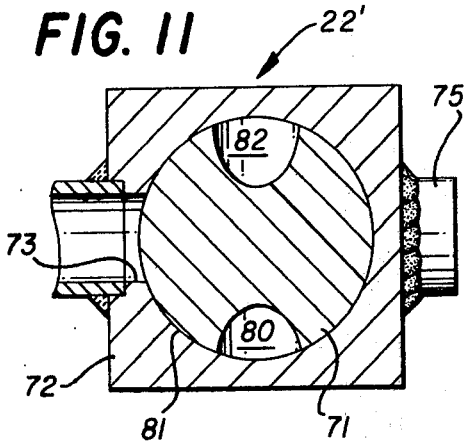
Figure 10:
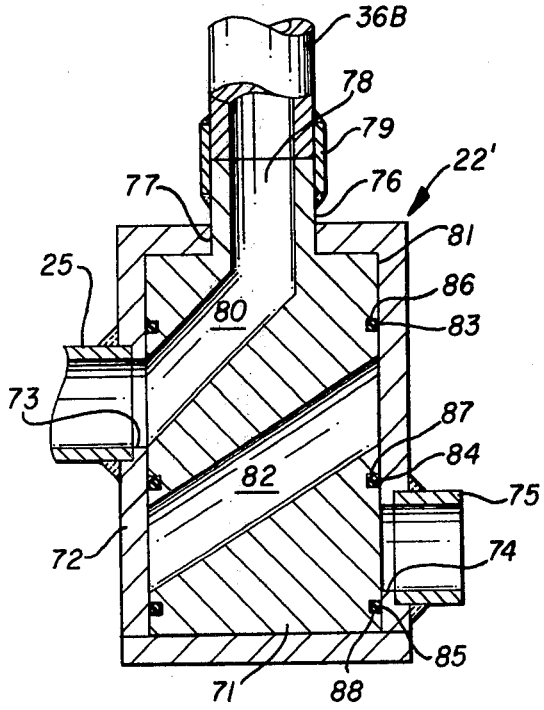
Figure 12:
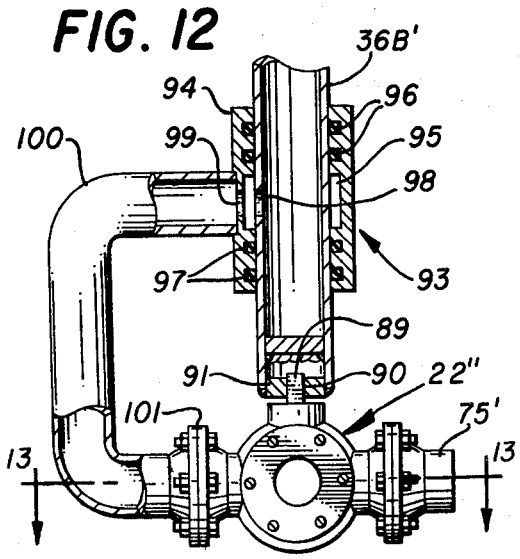
Figure 13:
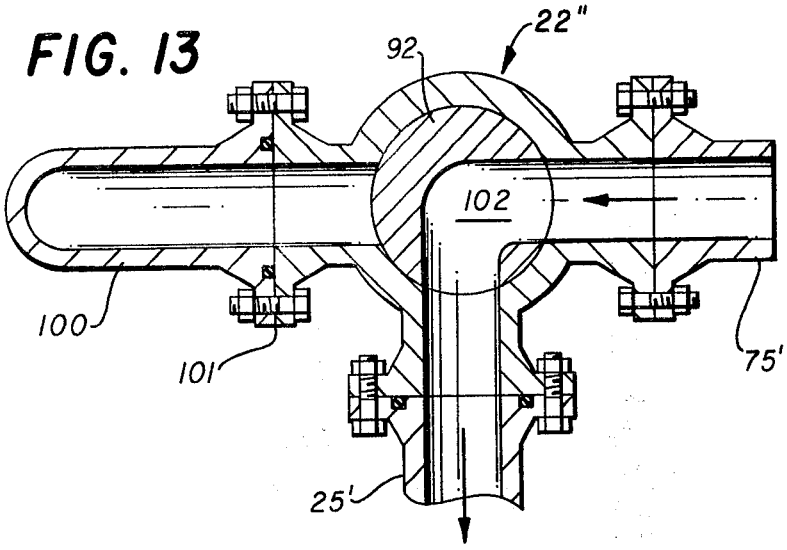
Figure 14:
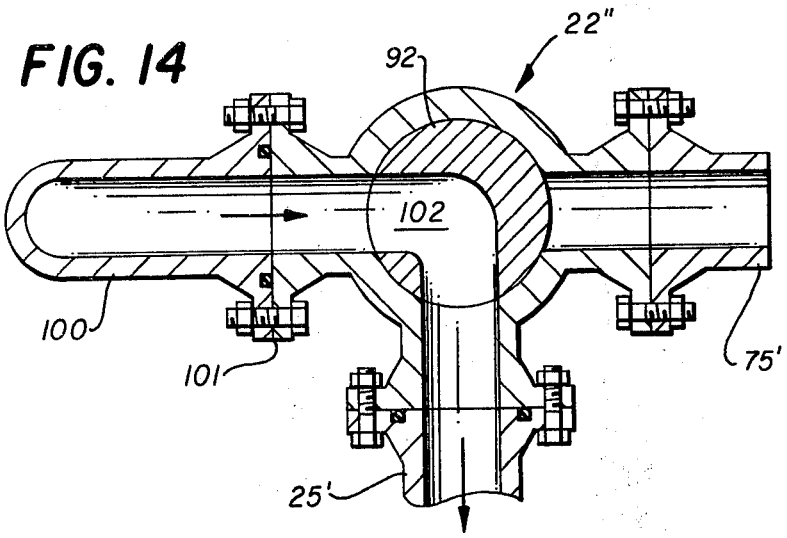
Figure 15:
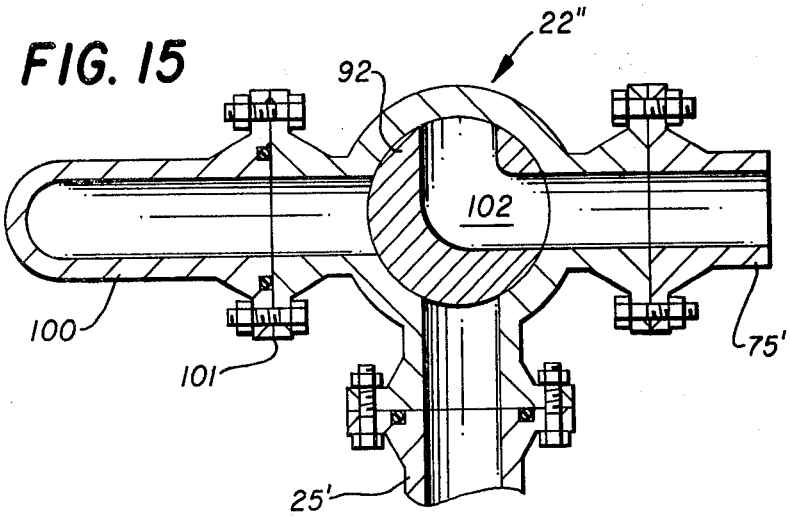

In the drawings:

FIG. 1 represents an elevation view of an offshore marine platform structure with a combination reach rod and grouting system;

FIG. 2, a partial broken away and sectioned elevation view of a platform leg showing leg piling and sleeve annulus detail and the combination reach rod and grouting system used with the leg;

FIG. 3, a partial broken away and sectioned elevation view of another platform leg with a combination reach rod and grouting system employing only one tee for grout feeding the leg annulus;

FIG. 4, a broken away and sectioned elevation view of a tee connection taken primarily along line 4—4 of FIG. 2;

FIG. 5, another broken and sectioned elevation view of a tee connection taken primarily along line 5—5 of FIG. 4;

FIG. 6, a broken away and sectioned elevation view of the top portion of the upper tee connection that permits through passage of a flow stop ball to a lower tee taken primarily along line 6—6 of FIG. 2;

FIG. 7, a partial broken away and sectioned view of an inflatable packer seal used in place of the back pressure seal of FIG. 2;

FIG. 8, a partial broken away and sectioned elevation view of a three position valve positioned to pass sea water;

FIG. 9, a broken away and sectioned view of the three position valve taken along line 9—9 of FIG. 8;

FIG. 10, a partial broken away and sectioned elevation view showing the valve positioned to pass material from the reach rod to the annulus;

FIG. 11, a broken away and sectioned view like FIG. 9 of the valve with the valve core turned to a shut off position;

FIG. 12, a partial broken away and sectioned elevation view of an alternate reach rod operated three position valve;

FIG. 13, a broken away and sectioned view of the three positioned valve of FIG. 12 taken along line 13—13 of FIG. 12 with the core turned to the flood position;

FIG. 14, a view like FIG. 13 with the valve core turned to the grout position; and, FIG. 15, a view like FIGS. 13 and 14 with the valve core turned to the shut off position.

Referring to the drawings:

The offshore platform structure 10 of FIG. 1 is equipped with a number of downwardly extending legs such as legs 11A and 11B that have upward extensions 12 fastened as by welding to the top plates 13 of the legs 11A and 11B. Top plates 13 on the top of the inner cylindrical piling tubes 14, referring also to FIG. 2, of the legs 11A, 11B and back legs 11 support extensions 12 and the service platform 15 mounted thereabove. Each leg 11 also includes a piling sleeve 16 that forms an annulus 17 with the piling tube 14 of that leg 11 sealed at the top by truncated conical top plate 18 welded in place so as to completely seal he annulus 17. The top plates 18 that could be flat instead of truncated cones or even an annular extension of top plates 13 also serve to help hold the piling sleeves 17 in proper spaced relation to their respective piling tubes 14. A back pressure seal 19 of the constant tension type set in place at the bottom of piling sleeve 16 also aids in holding the piling sleeves 16 and respective piling tubes 14 in proper spaced relation. The legs 11 generally extend from above the water surface 20 to below the mud line 21 at the sea bed with it being recognized that some legs of some offshore platforms do not extend into the sea bed. Further, the inner cylindrical piling tubes 14, as a general rule, are longer than their piling sleeves 16 so as to be pile driven into the sea bed further than the piling sleeves 16.

Each leg 11 is equipped with a flood valve 22 in the lower region thereof that may be opened and closed by a reach rod 23 extended from a handle 24 at the top of the leg 11 to the flood valve 22 in a line 25 in fluid communication with the leg annulus 17 that may be opened to the sea through the flood valve 22. Flood valves 22 are useful for controlled flooding of legs 11 in tilting and positioning the mounting leg structure 26 of an offshore platform in the upright state for driving of the piles 14. Flood valves 22 are also used in some instances as an annulus outlet for the air pressure blow removal of mud and water from a leg annulus 17. High pressure air from air pressure source 27 is fed through line 28 as controlled by valve 29 in air pressurizing leg annulus 17. Valve 29 is a three position valve whereby it may be shut off, positioned to pass high pressure air to annulus 17, or positioned to exhaust air from annulus 17 through outlet line 30.

Grout is supplied to leg annulus 17 from grout supply source 31 through grout line 32 as controlled by grout line valve 33 and/or grout line pump 34. However, instead of grout line 32 being directly connected through a fitting through piling sleeve 16 to annulus 17 the grout line 32 is connected to a fitting 35 that in turn is connected to reach rod 23 that is, generally, in the form of a pipe 36 passed through a brace and bearing support unit 37 of which there may be more than one mounted on sleeve 16 to an upper tee 38 therethrough on to another lower tee 39 and on down finally to flood valve 22. Flood valve 22 in some instances is a three position valve whereby it may be shut off, positioned to pass material fed to and through the reach rod 23 to annulus 17, or positioned to pass sea water to the annulus 17 in a flooding operation or purging water and/or mud from the annulus with sufficient air pressure applied to the annulus 17. Flush water is also supplied to leg annulus 17 from flush water pump and supply source 40 through water line 41 as controlled by water line valve 42 with water line 41 also connected through fitting 35 to reach rod 23. With the embodiment of FIG. 2 the grout line 32 and the flush water line 41 are flexible lines such as flexible hose to permit rotational movement of reach rod pipe 36 as turned by handle 24 in operating flood valve 22. With the embodiment of FIG. 3, however, the grout line 32' and the flush water line 41' are fixed non-flexible lines with the fitting 35' connected for fluid communication with the interior of reach rod pipe 36' through a slip joint fitting 42' that permits relative rotational movement of the pipe 36' in turning flood valve 22. The two grout and water feed line interconnects to reach rod pipes 36 and 36' could be interchanged between the embodiments as could some of the other features shown with respect to one or the other thereof. With the embodiment of FIG. 3, there is only one tee a tee 38' for feeding of grout to the annulus 17 from relatively low on reach rod 23' closely located to flood valve 22.

Referring to FIG. 4 much of the interior detail of tee 39 is shown with the bottom of reach rod pipe 36A a press fit into socket opening 43 of coupling 44 that is welded to thrust washer 45 that rests on the top 46 of tee body upper seal member 47 to help support the weight of the reach rod 23 while permitting relative rotation thereof. The lower reach rod pipe 36B extends into the tee body to a press fit at the top in socket bottom opening 48 of coupling 44. Upper seal member 47 and tee body lower seal member 49 that are interconnected by tee body center member 50 which are press fitted and/or welded together contain "O" ring seals 51, 52, 53 and 54 retained in internal "O" ring seal grooves 55, 56, 57 and 58, respectively. These are used to minimize, or prevent, leakage of water or grout from the tee 39 while permitting relative rotational movement of lower reach rod pipe 36B in turning the flood valve 22 to on and off positions. Referring also to FIG. 5 lower reach rod pipe 36B is provided with an opening 59 for flow of grout or flush water to tee chamber 60 and out through tee pipe 61 to annulus 17 if rupture disk 62 has been ruptured. Rupture disks 62 are generally required in all tees 38 and 39 of FIG. 2 and 38' of FIG. 3 to prevent back flow of sea water and/or mud from the annulus 17 to the interior of a reach rod 23 or 23' prior to flush water pressure or grout pressure rupture of a disk 62. The rupture disk 62 of a tee is held in place by the end of tee pipe 61 pressed in place in opening 63 of tee body central member of the respective tee 38, 38' or 39.

With the reach rod grouting system of FIG. 2 employing an upper tee 38 and a lower tee 39 the lower tee 39 is the primary grout feeder to annulus 17 and the upper tee 38 is a back-up tee that will be used only when the primary system fails, becomes clogged, or it is desired to feed higher in the annulus 17 after a period of low feed to the annulus 17. The secondary system is activated when a ball 64, or plug, inserted in the reach rod 23 at the top of pipe 36 by removing top cap 65 and dropping ball 64 in and then replacing the cap 65 which is a threaded on cap, is pumped down the reach rod to seat on the beveled ball stop seal closure seat 66 at the upper end of reduced diameter opening 67 of the coupling member 44. When ball 64 is seated on seat 66 grout or flush water flow down the reach rod is blocked from tee 39. The rupture disk 62 of the upper tee 38 may then be ruptured when the pressure of circulating flush water or grout is raised higher than the rupture disk 62 of tee 38 can withstand to begin a second stage grouting operation. Water circulation is generally required during the interim period between the two grouting stages to insure that any grout left in the line from the upper fee to the top of the reach rod 23 does not set up and block the line of feed therethrough and the line of feed remain usable for the start of the second stage grouting operation. In a reach rod grouting system employing two or more tee units spaced up the reach rod it is important that the rupture disks 62 be ruptured sequentially bottom tee disk first and next up next for a subsequent grouting stage. This may be accomplished through use of disks 62 having different rupture pressure values, 500 p.s.i. being a typical rupture disk rupture value, and/or by the different hydrostatic head variations down the reach rod. In a multi-tee reach rod grouting system such as the two tee embodiment of FIG. 2 it is important that the ball 64 used to block off the lower tee 39 freely pass through the interior of the upper tee 38. This is accomplished with the internal modification of tee 38 from the tee 39 shown in FIG. 6 where there is no such restricted diameter opening 67 and seat 66 as with the coupling member 44 of tee 39 as shown in FIG. 4 in the coupling member 44' of tee 38 which in most other ways, other than for rupture rate of its disk 62 is substantially the same as tee 39.

An inflatable packer seal 68 of a conventional nature is shown in FIG. 7 that can be used in place of the lower seal 19 of FIG. 2. Air pressure through line 69 and a fitting structure 70 to the inflatable packer seal 68 is controlled as required for inflated sealing of the packer seal 68 or releasing seal pressure.

The three position valve 22' of FIGS. 8, 9, 10 and 11 has a rotatable valve core plug 71 contained within valve housing 72 that has a wall opening 73 in fluid communication with line 25 and a wall opening 74 in fluid communication with the sea through stub pipe 75. The valve core plug 71 is provided with an upper stem 76 that extends through opening 77 in the top of valve housing 72 and has an internal passage 78 in fluid communication with the hollow interior of lower reach rod pipe 36B. The valve stem 76 and pipe 36B are fastened together by a cylindrical sleeve 79 welded to the stem and the pipe in order that the valve core plug 71 may be rotated within housing 72 by twist turning of the reach rod pipe to open and close the flood valve 22'. Internal passage 78 interconnects with an angled passage 80 that slants from passage 78 to the cylindrical wall 81 of valve plug 71 and another slanted passage 82 is provided through the valve plug 71. These passages are so positioned and shaped in valve plug 71 as to in the flood position shown in FIGS. 8 and 9 permit flow through passage 82 to permit flooding through line 25 to annulus 17 or purging of water from annulus 17 by air pressure in reverse while grout feed is shut off. When valve plug 71 is turned to the position shown in FIG. 10 it is positioned to pass material, such as grout, through the valve 22' from the lower reach rod pipe 36B to pipe 25 and annulus 17. In a third valve core plug 71 position, as shown in FIG. 11, the valve 22' is in a closed state without internal passage communication with either valve housing wall opening 73 or 74. Annular "O" rings 83, 84 and 85 contained in valve plug grooves 86, 87 and 88, respectively, aid in sealing flow sections of the valve one from the other.

The three position valve 22'' of FIGS. 12, 13, 14 and 15 is a three position valve having a valve stem 89 extended from the top that is welded in an end plug 91 welded in place to the bottom end of lower reach rod pipe 36B' in order that the valve stem 89, and thereby the valve core member 92, be turnable with rotation of the reach rod through the three positions, the flood position illustrated in FIG. 13, the grout position illustrated in FIG. 14, and the off position shown in FIG. 15. With the three position valve 22'' an adapter tee assembly 93 is mounted on lower reach rod pipe 36B' in order that grout may be fed from pipe 36B' to and through valve 22'' to annulus 17 when the valve core member 92 is in the grout feed position of FIG. 14. Adapter tee assembly 93 includes a cylindrical housing 94 having an annular chamber 95 with upper and lower "O" ring seal ring assemblies 96 and 97 within which reach rod pipe 36B' may rotate for turning the stem 89 and core member 92 of valve 22''. Grout flows through pipe opening 98 and opening 99 in the cylindrical housing 94 to "U" shaped pipe 100 for delivery to the valve 22'' via flange piping connection 101. The valve core member 92 has a right angle passage 102 that is shiftable to implement the three valve position states desired.

Whereas this invention has been described with respect to several embodiments thereof, it should be realized that various changes may be made without departing from the essential contributions at the art made by the teachings hereof.

We claim:

1. In an offshore marine pile and pile guide structure, generally in an upright orientation when installed in place, with piling driven into a bed at the bottom and on above water platform at the top: a pile guide sleeve adapted to receive a pile driven therethrough with an annulus formed between the sleeve and its pile; seal means set in place low in the annulus; flood valve means connected through fluid passage means to the interior of said annulus above said seal means; a reach rod structure including hollow piping, generally in upright orientation, having upper and lower ends, with the piping lower end connected to said flood valve means for controlled actuation of said flood valve means between open and closed valve positions; a grout supply system including grout feed line means connected to said annulus; wherein hollow piping of said reach rod structure is a part of said grout feed line means; said grout feed line means includes grout passage means interconnecting said reach rod structure hollow piping and said annulus; said grout passage means includes said flood valve means and said fluid passage means; and wherein said flood valve means is a three way valve that has open and close positions to flood water and a third position to feed grout through the flood valve and said fluid passage means to said annulus.

2. In an offshore marine pile and pile guide structure, generally in an upright orientation when installed in place, with piling driven into a bed at the bottom and an above water platform at the top: a pile guide sleeve adapted to receive a pile driven therethrough with an annulus formed between the sleeve and its pile; seal means set in place low in the annulus; flood valve means connected through fluid passage means to the interior of said annulus above said seal means; a reach rod structure including hollow piping, generally in upright orientation, having upper and lower ends, with the piping lower end connected to said flood valve means for controlled actuation of said flood valve means between open and closed valve positions; a grout supply system including grout feed line means connected to said annulus; wherein hollow piping of said reach rod structure is a part of said grout feed line means, said grout feed line means includes grout passage means interconnecting said reach rod structure hollow piping and said annulus; said grout passage means includes said flood valve means and said fluid passage means; and wherein said flood valve is a rotationally actuated valve between open and closed positions; said reach rod is rotatably mounted for operation of said flood valve by rotation of the reach rod hollow piping from above; and reach rod rotation drive means.

3. The improved apparatus of claim 2, wherein said reach rod rotation drive means is a handle at the upper end of the reach rod structure.

4. In an offshore marine pile and pile guide structure, generally in an upright orientation when installed in place, with piling driven into a bed at the bottom and an above water platform at the top: a pile guide sleeve adapted to receive a pile driven therethrough with an annulus formed between the sleeve and its pile; seal means set in place low in the annulus; flood valve means connected through fluid passage means to the interior of said annulus above said seal means; a reach rod structure including hollow piping, generally in upright orientation, having upper and lower ends, with the piping lower end connected to said flood valve means for controlled actuation of said flood valve means between open and closed valve positions; a grout supply system including grout feed line means connected to said annulus; wherein hollow piping of said reach rod structure is a part of said grout feed line means; said grout feed line means includes grout passage means interconnecting said reach rod structure hollow piping and said annulus; and wherein said flood valve is a rotationally actuated valve between open and closed positions; said reach rod is rotatably mounted for operation of said flood valve by rotation of the reach rod hollow piping from above; and reach rod rotation drive means.

5. The improved apparatus of claim 4, wherein said reach rod rotation drive means is a handle at the upper end of the reach rod structure.

6. The improved apparatus of claim 4, wherein said grout passage means includes a plurality of tee connections spaced at various locations up and down said hollow piping in said reach rod structure, each having a line connection as said grout passage means interconnecting said reach rod structure hollow piping and said annulus.

7. The improved apparatus of claim 6, wherein rupture disk means is provided in said line connection from each of said tee connections.

8. The improved apparatus of claim 7, wherein said rupture disk means are of graduated rupture values-lower rupture value for the rupture disk means at a lower tee of said plurality of tee connections to progressively higher rupture values for the respective rupture disk means located at progressively higher tees.

9. The improved apparatus of claim 8, wherein grout flow blocking means is provided for any tee means below the uppermost tee in a reach rod equipped with a plurality of tee connections.

10. The improved apparatus of claim 9, wherein said grout flow blocking means is a plug seat and plug sized to seat on said plug seat in the top of lower tee means; and with said plug sized to pass through tee means positioned in said reach rod above the said lower tee means.

11. The improved apparatus of claim 10, wherein said plug is a ball and said plug seat is a ball seat.

12. The improved apparatus of claim 10, wherein said reach rod has a top cap that may be removed to insert said plug for pumping of said plug down the reach rod to seating engagement stop on the plug seat it is sized to engage.

13. The improved apparatus of claim 4, wherein said grout supply system includes a flexible grout supply hose from a grout source connected to an upper section adjacent the upper end of said reach rod; with said flexible hose permitting rotational movement of said reach rod for actuation of said flood valve.

14. The improved apparatus of claim 13, wherein a flexible water supply line connected to a water supply source is also connected to said upper section of said reach rod.

15. The improved apparatus of claim 14, with flow control means in the supply line connection to said flexible grout supply hose and water flow control means in the water supply connected to said flexible water supply line.

16. The improved apparatus of claim 4, wherein grout feed line means and water supply lines both having flow control structure means are connected to said reach rod through slip joint fitting means.

17. The improved apparatus of claim 4, wherein said grout passage means includes tee connection means at a location on said hollow piping in said reach rod structure; and with said tee connection means having a line connection in said grout passage means interconnecting said reach rod structure hollow piping and said annulus.

18. In a grouting system for an offshore structure including one or more downward extended legs with a leg annulus formed between a leg piling and a piling sleeve: a flood valve connected to said leg annulus for opening and closing said leg annulus to the flow of water; a reach rod structure interconnecting said flood valve and valve opening and closing control means and including piping; with piping of said reach rod structure included as part of said grouting system for feeding grout to said annulus; wherein said annulus includes a seal at the bottom and a closed top; and said grout feed line means includes grout passage means interconnecting said reach rod structure hollow piping and said annulus; said grout passage means includes said flood valve means and said fluid passage means; and wherein said flood valve means is a three way valve that has open and close positions to flood water and a third position to feed grout through the flood valve and said fluid passage means to said annulus.

19. In a grouting system for an offshore structure including one or more downward extended legs with a leg annulus formed between a leg piling and a piling sleeve: a flood valve connected to said leg annulus for opening and closing said leg annulus to the flow of water; a reach rod structure interconnecting said flood valve and valve opening and closing control means and including piping; with piping of said reach rod structure included as part of said grouting system for feeding grout to said annulus; wherein said annulus includes a seal at the bottom and a closed top; and said grout feed line means includes grout passage means interconnecting said reach rod structure hollow piping and said annulus; said grout passage means includes said flood valve means and said fluid passage means; and wherein said flood valve is a rotationally actuated valve between open and closed positions; said reach rod is rotatably mounted for operation of said flood valve by rotation of the reach rod hollow piping from above; and reach rod rotation drive means.

20. The grouting system of claim 17, wherein said reach rod rotation drive means is a handle at the top of the reach rod structure.

21. In a grouting system for an offshore structure including one or more downward extended legs with a leg annulus formed between a leg piling and a piling sleeve: a flood valve connected to said leg annulus for opening and closing said leg annulus to the flow of water; a reach rod structure interconnecting said flood valve and valve opening and closing control means and including piping; with piping of said reach rod structure included as part of said grouting system for feeding grout to said annulus; wherein said annulus includes a seal at the bottom and a closed top; and said grout feed line means includes grout passage means interconnecting said reach rod structure hollow piping and said annulus; and wherein said flood valve is a rotationally actuated valve between open and closed positions; said reach rod is rotatably mounted for operation of said flood valve by rotation of the reach rod hollow piping from above; and reach rod rotation drive means.

22. The grouting system of claim 21, wherein said reach rod rotation drive means is a handle at the top of the reach rod structure.

23. The grouting system of claim 21, wherein said grout passage means includes a plurality of tee connections in said reach rod structure, each having a line connection as said grout passage means interconnecting said reach rod structure hollow piping and said annulus.

24. The grouting system of claim 23, wherein rupture disk means is provided in said line connection from each of said tee connections.

25. The grouting system of claim 24, wherein said rupture disk means are of graduated rupture values- lower rupture value at a lower tee to progressively higher rupture values at progressively higher tees.

26. The grouting system of claim 25, wherein grout flow blocking means is provided for any tee means below the uppermost tee in a reach rod equipped with a plurality of tee connections.

27. The grouting system of claim 26, wherein said grout flow blocking means is a plug seat and plug sized to seat on said plug seat in the top of lower tee means; and with said plug sized to pass through tee means positioned in said reach rod above the said lower tee means.

28. The grouting system of claim 27, wherein said plug is a ball and said plug seat is a ball seat.

29. The grouting system of claim 27, wherein said reach rod has a top cap that may be removed to insert said plug for pumping of said plug down the reach rod to seating engagement stop on the plug seat it is sized to engage.

30. The grouting system of claim 21, wherein said grout supply system includes a flexible grout supply hose from a grout source connected to an upper section of said reach rod, with said flexible hose permitting rotational movement of said reach rod for actuation of said flood valve.

31. The grouting system of claim 30, wherein a flexible water supply line connected to a water supply source is also connected to said upper section of said reach rod.

32. The grouting system of claim 31, with flow control means in the supply line connection to said flexible grout supply hose; and water flow control means in the water supply connected to said flexible water supply line.

33. The grouting system of claim 31, wherein grout feed line means and water supply lines both having flow control structure means are connected to said reach rod through slip joint fitting means.

34. A flooding and grouting valve mechanism for use in an offshore jacket of the type which is to be floated to an offshore work site, submerged onto a seabed by flooding of at least some sleeves of the jacket, and then anchored to the seabed by piles driven through the sleeves and grouted thereto, said flooding and grouting valve mechanism being attached to a sleeve and including:

means defining a flood opening for admitting ambient sea water, means defining a grout opening for admitting grout, means defining a grout conduit coupled to said grout opening, an outlet communicating with an inlet of the sleeve, which inlet communicates with a compartment within the sleeve to conduct thereto sea water or grout, and valve means for uncovering said flood and grout openings to selectively admit sea water or grout for delivery to said compartment, said grout conduit means including a portion forming said valve means for uncovering said flood openings.

35. A flooding and grouting valve mechanism according to claim 34, wherein said valve means comprises a gate rotatably mounted for selectively covering and uncovering said flood opening, and a valve mounted on said gate and carrying said grout opening, said gate being hollow to define a passage for grout received through said grout opening.

36. A method for installing an offshore jacket onto a seabed comprising the steps of:

floating the jacket to a work site while maintaining compartments within sleeves of said jacket in a bouyant state, using valve actuating, conduit-defining rod means to actuate a valve mechanism on one of said sleeves of said jacket to communicate a flood opening on said valve mechanism with a flood/grout inlet of a said sleeve to admit ambient sea water through said flood/grout inlet to flood a said compartment, causing said jacket to tend to be lowered onto the seabed, actuating said valve mechanism to block communication between said flood opening and said flood/grout inlet, driving anchor piles through said sleeves, supplying grout through said conduit defining rod means to a normally closed grout opening carried by said valve mechanism and, pumping said grout though said conduit defining rod means whereby said grout forces open said grout opening and travels though said flood/grout inlet.

* * * * *

UNITED STATES PATENT OFFICE
CERTIFICATE OF CORRECTION

Patent No. 4,412,759 Dated November 1, 1983

Inventor(s) Frederick G. Britton and Don B. Landers

It is certified that error appears in the above-identified patent and that said Letters Patent are hereby corrected as shown below:

Column 3, line 21, delete the word "he" and insert therefor --the--.

Column 5, line 9, delete the word "fee" and insert therefor --tee--.

Column 9, line 7, delete the number "17" and insert therefor --19--.

Column 10, line 64, delete the word "though" and insert therefor --through--.

Signed and Sealed this

*Twenty-eighth* Day of *February 1984*

[SEAL]

*Attest:*

GERALD J. MOSSINGHOFF

*Attesting Officer* *Commissioner of Patents and Trademarks*